US011662172B2

(12) United States Patent
Langenbeck

(10) Patent No.: US 11,662,172 B2
(45) Date of Patent: May 30, 2023

(54) INTEGRATED BARREL AND MUZZLE DEVICE SYSTEM

(71) Applicant: Keith A. Langenbeck, Keller, TX (US)

(72) Inventor: Keith A. Langenbeck, Keller, TX (US)

( * ) Notice: Subject to any disclaimer, the term of this patent is extended or adjusted under 35 U.S.C. 154(b) by 0 days.

(21) Appl. No.: 17/461,881

(22) Filed: Aug. 30, 2021

(65) Prior Publication Data

US 2022/0099401 A1 Mar. 31, 2022

Related U.S. Application Data

(60) Provisional application No. 63/072,189, filed on Aug. 30, 2020.

(51) Int. Cl.
*F41A 21/30* (2006.01)
*F41A 21/48* (2006.01)
*F41A 21/32* (2006.01)

(52) U.S. Cl.
CPC ..... *F41A 21/30* (2013.01); *F41A 21/325* (2013.01); *F41A 21/482* (2013.01)

(58) Field of Classification Search
CPC ..... F41A 21/30; F41A 21/32; F41A 21/325; F41A 21/482
USPC ..... 89/14.4
See application file for complete search history.

(56) References Cited

U.S. PATENT DOCUMENTS 4,974,489 A * 12/1990 Fishbaugh ..... F41A 21/30 89/14.4
7,832,323 B1 * 11/2010 Davies ..... F41A 21/34 89/14.4
2015/0001001 A1 * 1/2015 Wilson ..... F41A 21/36 219/76.1
2015/0260473 A1 * 9/2015 Barney ..... F41A 21/30 89/14.4
2015/0354422 A1 * 12/2015 Liskey ..... F41A 21/30 89/14.4
2018/0031346 A1 * 2/2018 Washburn, III ..... F41A 21/30
2018/0266783 A1 * 9/2018 Morreau ..... F41A 21/30
(Continued)

FOREIGN PATENT DOCUMENTS

DE 102015111066 A1 * 1/2017 ..... F41A 21/10

OTHER PUBLICATIONS

Various Authors, Recommended bullet clearance on a suppressor, Aug. 24, 2009, Internet publication, pp. 1-2, found here: https://www.each interchangeable vent tubesnipershide.com/shooting/threads/recommended-bullet-clearance-on-a-suppressor.14385/ (Year: 2009).*

*Primary Examiner* — Bret Hayes
(74) *Attorney, Agent, or Firm* — Lyman Moulton, Esq.; MoultonPatents, PLLC

(57) ABSTRACT

The disclosed Integrated Barrel and Muzzle Device System (IBMDS) is a firearm suppressor having an interchangeable projectile tube attached to a muzzle endcap and to a gas block endcap proximal a threaded muzzle of the firearm. The disclosure also includes a suppressor tube body configured to receive the muzzle endcap and the gas block front endcap located against a distal face of the threaded muzzle. The disclosure additionally includes a suppressor element received into the suppressor tube body proximal the muzzle endcap, wherein the suppressor element channels propellant gases from openings defined in the interchangeable projectile tube through an array of open cells.

15 Claims, 7 Drawing Sheets

(56) References Cited

U.S. PATENT DOCUMENTS

| | | | | |
|---|---|---|---|---|
| 2019/0277591 | A1* | 9/2019 | Schwartzkopf | F41A 21/30 |
| 2020/0166304 | A1* | 5/2020 | Martin | F41A 21/28 |

* cited by examiner

INTEGRATED BARREL AND MUZZLE DEVICE SYSTEM

CROSS-REFERENCE TO RELATED APPLICATION

This application claims the benefit of the priority date of earlier filed U.S. Provisional Patent Application Ser. No. 63/072,189 titled 'Integrated Barrel and Muzzle Device System' filed Aug. 30, 2020 by Keith A. Langenbeck, and is incorporated herein by reference in its entirety.

BACKGROUND OF THE INVENTION

The A firearm sound suppressor, suppressor or sound moderator, is a muzzle device that reduces the acoustic intensity of the muzzle report (sound of a gunshot) and the recoil when a gun (firearm or air gun) is discharged, by modulating the speed and pressure of the propellant gas from the muzzle and hence suppressing the muzzle blast. Like other muzzle devices, a silencer can be a detachable accessory mounted to the muzzle, or an integral part of the barrel.

Hunters using centerfire rifles find silencers bring various important benefits that outweigh the extra weight and resulting change in the firearm's center of gravity. The most important advantage of a suppressor is the hearing protection for the shooter as well as their companions. Many hunters have suffered permanent hearing damage due to someone else firing a high-caliber gun too closely without warning. By reducing noise, recoil and muzzle-blast, it also enables the firer to follow through calmly on their first shot and fire a further carefully aimed shot without delay if necessary.

Apart from integral silencers that are integrated as a part of the firearm's barrel, most suppressors have a female threaded end, which attaches to male threads cut into the exterior of the barrel. These types of silencers are mostly used on handguns and rifles chambered in .22LR.

Military rifles such as the M16 or M14 often use quick-detach suppressors that use coarser than normal threads and are installed over an existing muzzle device such as a flash suppressor and can include a secondary locking mechanism to allow the shooter to quickly and safely add or remove a sound suppressor based on individual needs.

SUMMARY OF THE INVENTION

The disclosed Integrated Barrel and Muzzle Device System includes a firearm suppressor having an interchangeable projectile tube attached to a muzzle endcap and to a gas block endcap proximal a threaded muzzle of the firearm. The disclosure also includes a suppressor tube body configured to receive the muzzle endcap and the gas block endcap located against a distal face of the threaded muzzle. The disclosure additionally includes a suppressor element received into the suppressor tube body proximal the muzzle endcap, wherein the suppressor element channels propellant gases from openings defined in the interchangeable projectile tube through an array of open cells.

Other aspects and advantages of embodiments of the disclosure will become apparent from the following detailed description, taken in conjunction with the accompanying drawings, illustrated by way of example of the principles of the disclosure.

Figure 1:
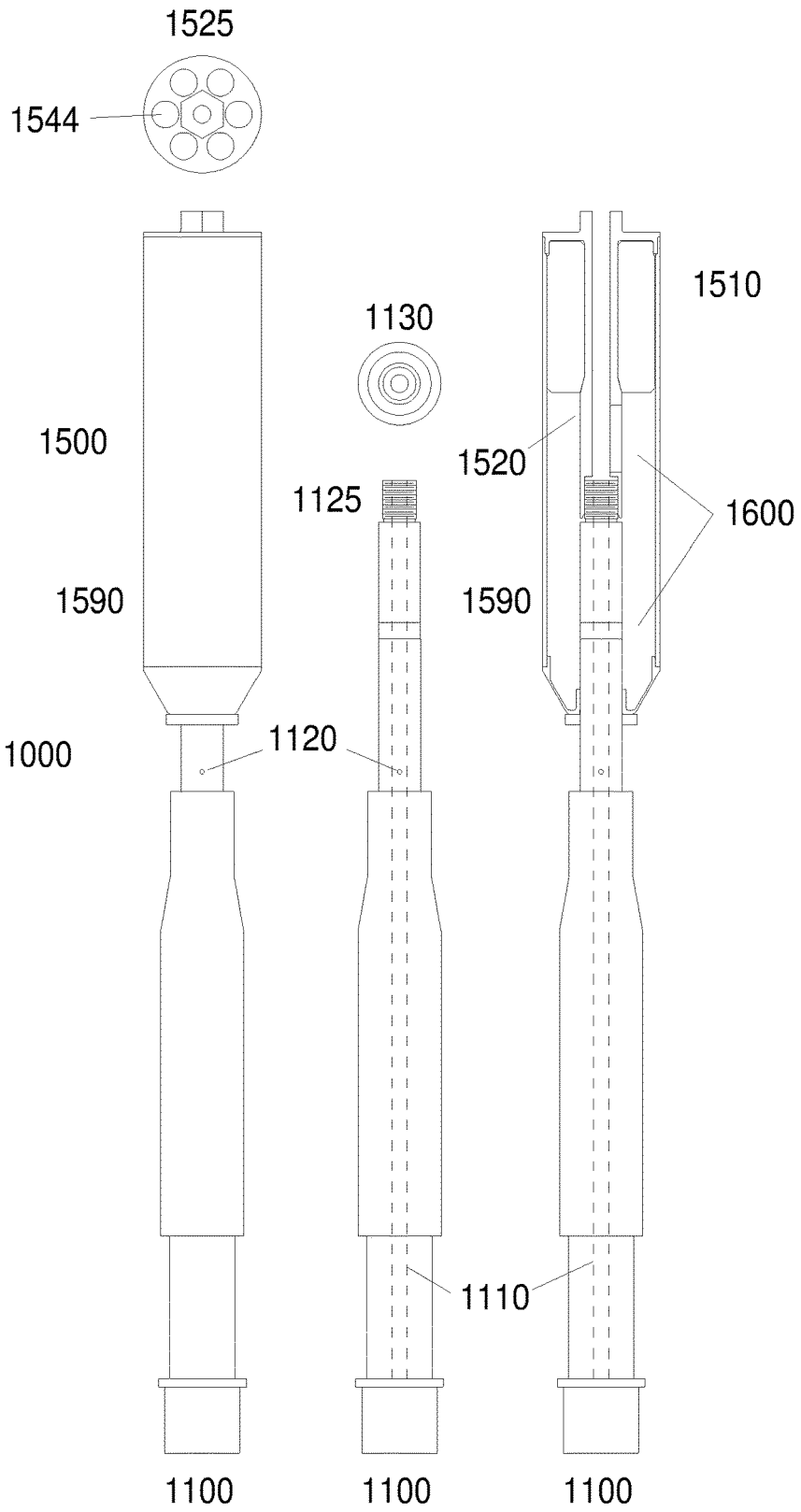
FIG. 1 illustrates the Integrated Barrel and Muzzle Device System (IBMDS) as applied to an M16/M4/AR15 rifle in accordance with an embodiment of the present disclosure.

Throughout the description, similar or same reference numbers may be used to identify similar or same elements in the several embodiments and drawings. Although specific embodiments of the invention have been illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

This application discloses novel and unobvious improvements to projectile performance and launch systems in small caliber weapons but the features and performance benefits could be applied to large caliber projectiles as well. Throughout the present disclosure and continuances and/or divisional disclosures thereof, the terms 'slug,''bullet,' and 'projectile' may be used interchangeably to generally define a solid mass expelled from a firearm, usually explosively. The term 'nominal' used throughout may define a measurement or a metric near a mean in a normal distribution. Furthermore, the term 'plateau' used in the present disclosure refers to a conventional definition thereof meaning a relatively level surface considerably raised above adjoining surfaces. The term 'waist' refers to a narrowing or at least one of a narrowest part of a shank of a bullet affected by machining or molding or other means before and after manufacture. The term 'endcap' is used synonymously with the term 'end cap' according to common usage.

This application discloses unique features and advancements in devices that attach to the end of small arms barrels to redirect muzzle blast and attenuate or suppress physical blast signature, visible muzzle flash and audible report of a weapon when fired.

FIG. 1 illustrates the Integrated Barrel and Muzzle Device System, hereinafter sometimes IBMDS, 1000 as applied to an M16/M4/AR15 rifle in accordance with an embodiment of the present disclosure. IBMDS 1000 is comprised of two major subsystems, the Barrel 1100 and the Muzzle Device 1500. Barrel 1100 includes gas vent hole 1120, phantom lines 1110 depicting the bore of the barrel, threaded muzzle end 1125 and end view of the barrel 1130.

Muzzle Device 1500 depicted in longitudinal section view 1510, extends back over the Barrel 1100 towards the gas block and breech. Muzzle Device 1500 is affixed by threaded attachment to the Barrel 1100. End view of the muzzle endcap 1525 depicts exhaust holes 1544 through which propellant gases are exhausted from the bore of Barrel 1100. Interior space 1600 is exterior to Barrel 1100 and interchangeable projectile tube 1520 and within tube body 1590.

Figure 2:
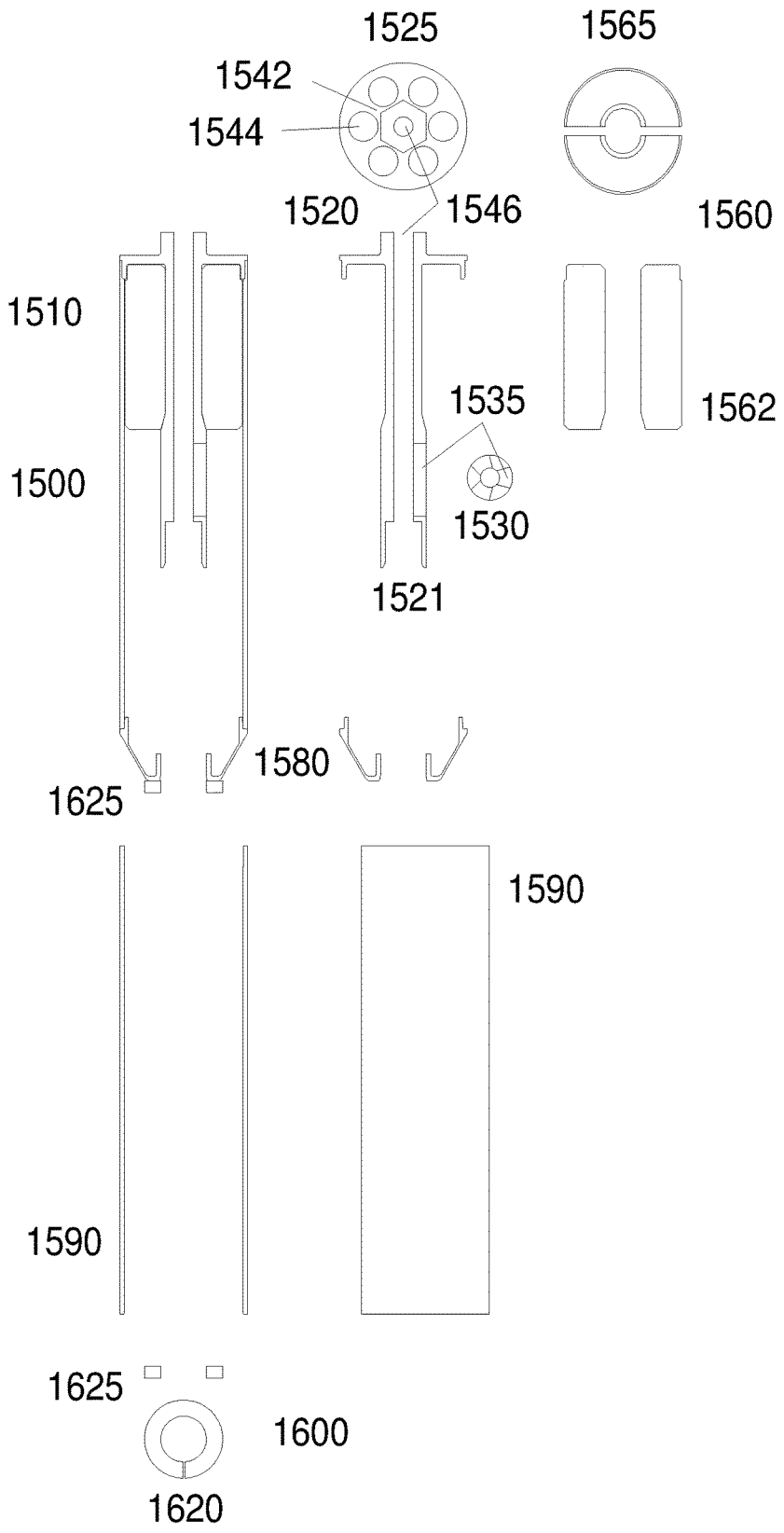
FIG. 2 illustrates Muzzle Device 1500 in longitudinal section and various parts in exploded views in accordance with an embodiment of the present disclosure.

FIG. 2 illustrates Muzzle Device 1500 in longitudinal section 1510 and various parts in exploded views in accordance with an embodiment of the present disclosure. Muzzle Device 1500 is comprised of tube body 1590, gas block end cap 1580 also known as a front endcap, interchangeable projectile tube 1520, suppressor elements 1560 and common split lock washer 1600.

End view of the muzzle endcap 1525 depicts exhaust holes 1544, hex end 1542 for attaching and removing Muzzle Device 1500 from Barrel 1100 and projectile exit hole 1546. Longitudinal section view of the interchangeable projectile tube 1520 depicts projectile exit hole 1546, internal threaded end 1521 for engagement with barrel external threaded end 1125 and projectile tube vent slot 1535 which discharges propellant gases into interior space 1600 as projectile moves past. Cross section view 1530 of the interchangeable projectile tube 1520 depicts three vent slots 1535 that discharge propellant gases into interior space 1600 as projectile moves past. Projectile tube vent slots 1535 could be holes that discharge propellant gases into interior space 1600.

Distal end of the interchangeable projectile tube 1520 has external threads for engagement with internal threads of distal end of tube body 1590. Gas block end cap 1580 would be seam welded to the proximate end of tube body 1590. When Muzzle Device 1500 is assembled and fully threaded onto Barrel 1100, gas block end cap 1580 captures lock washer 1600 between and flush up against rifle gas block, not shown in this depiction. Consequently, Muzzle Device 1500 is in a state of mechanical compression, which increases stiffness of barrel 1100 from the gas block to the muzzle. The interchangeable projectile tube 1520 is interchangeable with other interchangeable projectile tubes as described and shown below.

Muzzle Device suppressor elements 1560 are depicted as two half cylinders in end view 1565 and longitudinal view 1562. Suppressor elements 1560 within Muzzle Device 1500 attenuate or suppress muzzle flash, physical muzzle blast and audible report of the weapon. Suppressor elements 1560 can be removed for cleaning or replacement. Suppressor elements 1560 could be comprised of more than a single set of halves, each item having different porosity, hole size, architecture and etcetera.

Construction of suppressor elements 1560 could be open cell metal foam, 3D printed digital metal foam or various other materials and architectures with high surface area, low mass, circuitous and disruptive gas pathways in order to extract heat, reduce gas pressure and attenuate sound energy from the propellant gases that pass through and out exhaust holes 1544. Suppressor elements 1560 could have uniform or varying resistance to gas flow and variable porosity as the propellant gases move through the internal architecture. Propellant gases that enter interior space 1600 are intended to pass through suppressor elements 1560 and out of Muzzle Device 1500, not just absorbed or received within the suppressor elements 1560.

Configuration of Muzzle Device 1500 allows for use of the same tube body 1590, gas block end cap 1580 and suppressor elements 1560 in Muzzle Device 1500 for different caliber projectiles fired from a different barrel 1100. Different interchangeable projectile tubes 1520 with different inside diameter and internal threaded end 1521 would be changed to match with different diameter bore 1110 of Barrel 1100.

Attaching assembled Muzzle Device 1500 without suppressor elements 1560 would result in a blast forwarding device that projects unsuppressed propellant gases out of Muzzle Device 1500 through exhaust holes 1544 parallel to the barrel bore.

Figure 3:
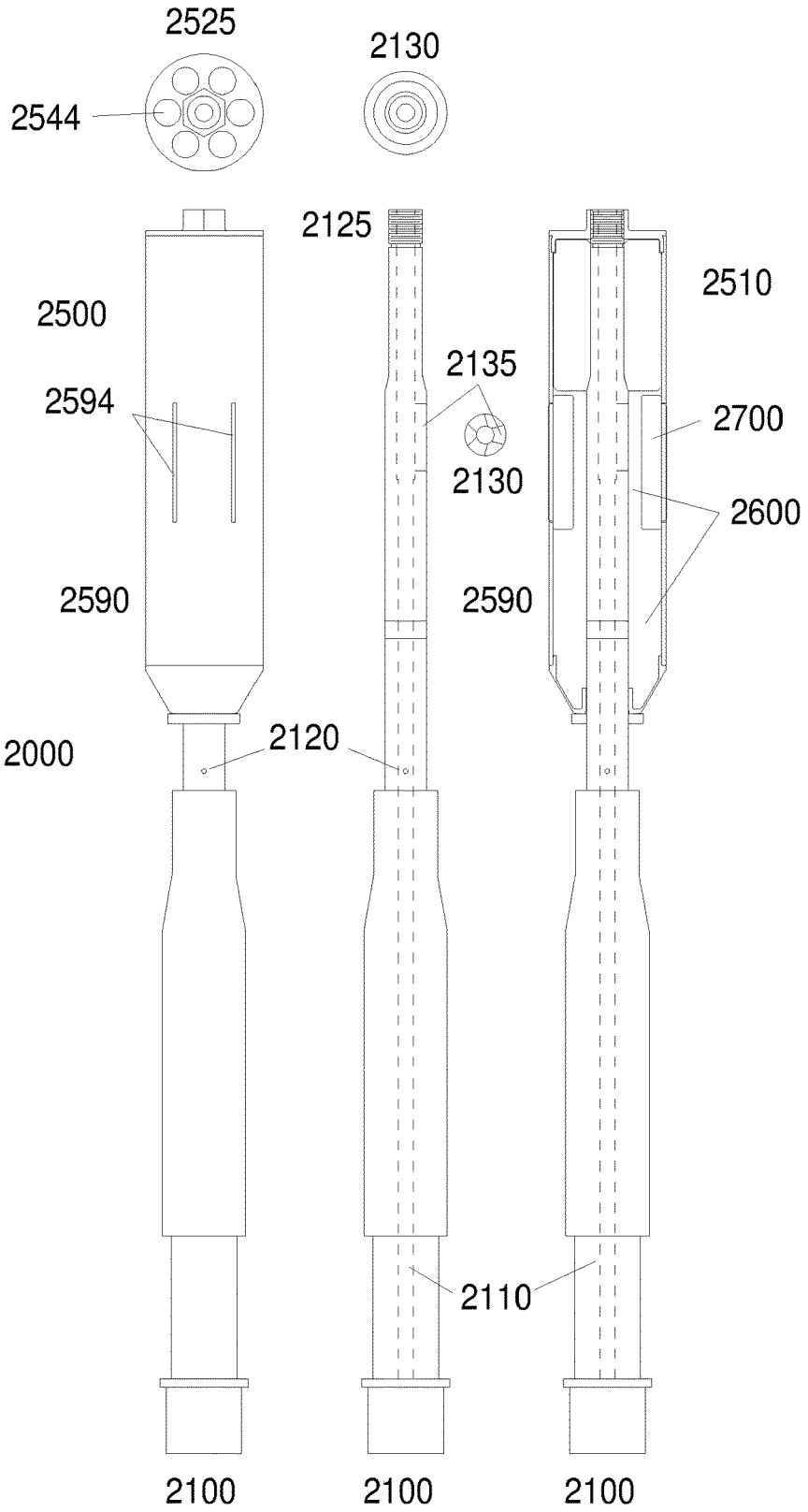
FIG. 3 illustrates an Integrated Barrel and Muzzle Device System 2000 similar to IBMDS 1000 and likewise used on an M16/M4/AR15 rifle in accordance with an embodiment of the present disclosure.

FIG. 3 illustrates an Integrated Barrel and Muzzle Device System 2000 similar to IBMDS 1000 and likewise used on an M16/M4/AR15 rifle in accordance with an embodiment of the present disclosure. IBMDS 2000 is comprised of two major subsystems, Barrel 2100 and Muzzle Device 2500. Barrel 2100 includes gas vent holes 2120, phantom lines 2110 depicting the bore of the barrel, threaded muzzle end 2125 and end view of the barrel 2130. Different than IBMDS 1000, IBMDS 2000 has an extended barrel 2100. Gas vent holes 2120 could be slots or circular holes.

Muzzle Device 2500, depicted in longitudinal section view 2510, extends back over the Barrel 2100 towards the gas block and breech. End view of the muzzle endcap 2525 of the Muzzle Device 2500, which is affixed by threaded attachment to the Barrel 2100, depicts exhaust holes 2544 through which propellant gases are exhausted parallel to the bore of Barrel 2100.

Interior space 2600 of Muzzle Device 2500 is exterior to Barrel 2100. Barrel 2100 has vent slots 2135 that discharge propellant gases into interior space 2600. Cross section 2130 of barrel 2100 depicts three vent slots 2135. Likewise, these slots 2135 could be holes in Barrel 2100.

Muzzle Device tube body 2590 has slits 2594 for receiving a portion of internal fins 2700. Internal fins 2700 are depicted nominally at the midsection of tube body 2590, which locates them above barrel vent slots 2135. When affixed by welding, internal fins 2700 add mechanical strength to tube body 2590 immediately above barrel vent slots 2135. Internal fins 2700 are depicted as straight and parallel to barrel bore 2100. This disclosure also anticipates that slits 2594 and internals fins 2700 would be angled or in a spiral arrangement. Such arrangement would induce a torque that tightens Muzzle Device 2500 onto barrel 2100 when propellant gases escape and expand into interior space 2600. It is anticipated that tube body 2590, internal fins 2700 and gas block end cap 1580 could be configured as a single, monolithic piece by 3D metal printing technology, also known as additive manufacturing. Reference 2560 refers to the longitudinal sectional view of the disclosure.

Figure 4:
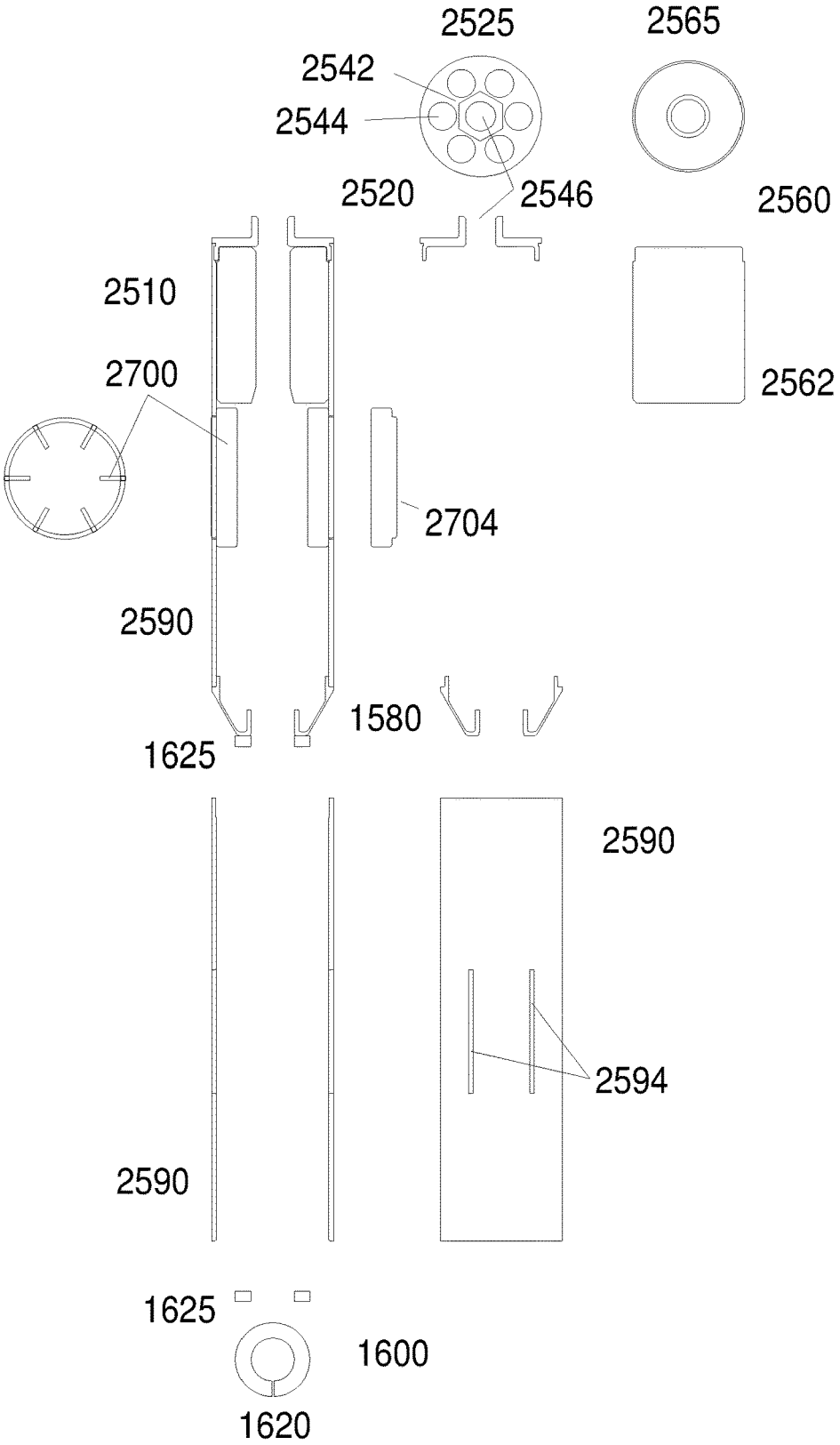
FIG. 4 illustrates Muzzle Device in longitudinal section and various parts in exploded views in accordance with an embodiment of the present disclosure.

FIG. 4 illustrates Muzzle Device 2500 in longitudinal section 2510 and various parts in exploded views in accordance with an embodiment of the present disclosure. Muzzle Device 2500 is comprised of muzzle end cap 2525, tube body 2590, internal fins 2700, suppressor element 2560, gas block end cap 1580 and common split lock washer 1600. Also depicted is internal fin tab 2704 that fits within tube body slit 2594 for affixing by welding.

End view of the muzzle endcap 2525 of end cap 2520 depicts exhaust holes 2544, hex end 2542 for attaching and removing Muzzle Device 2500 from Barrel 2100 and internally threaded hole 2546 for engagement with barrel external threaded end 2125. End cap 2520 has external threads for engagement with internal threads of distal end of tube body 2590. Gas block end cap 1580 would be seam welded to the proximate end of tube body 2590.

When Muzzle Device 2500 is assembled and fully threaded onto Barrel 2100, gas block end cap 1580 captures and compresses lock washer 1600 between and flush up against rifle gas block, not shown in this depiction. Consequently, Muzzle Device 2500 is in a state of mechanical compression, which increases stiffness of barrel 2100 from the gas block to the muzzle.

Suppressor element 2560 is depicted as a single cylinder in end view 2565 and longitudinal view 2562. Suppressor element 2560 can be readily added over barrel 2100 and within Muzzle Device 2500 to attenuate or suppress muzzle flash, physical muzzle blast and audible report of the weapon. Suppressor element 2560 can be removed for cleaning or replacement. Half cylinder suppressor elements 1560 as depicted in FIG. 2 could function in Muzzle Device 2500 in lieu of suppressor element 2560.

Construction of suppressor element 2560 could be open cell metal foam, 3D printed digital metal foam or by various other methods, materials and architectures with high surface area, low mass, circuitous and disruptive gas pathways in order to extract heat, reduce gas pressure and attenuate sound energy from the propellant gases that pass through and out of projectile tube exhaust holes 2544. Suppressor element 1560 could have uniform or varying resistance to gas flow and variable porosity as the propellant gases move through the internal architecture. Propellant gases that enter interior space 2600 are intended to pass through suppressor element 2560 and out, not just absorbed or received within the suppressor element 2560.

Configuration of Muzzle Device 2500 and the manner in which propellant gases are directed through suppressor element 2560 allows for use of the same tube body 2590, end cap 2520, gas block end cap 1580 and suppressor element 2560 in Muzzle Device 2500 for different caliber projectiles fired from a different barrel 2100. Outside profiles of different barrels 2100 would be the same but have different diameter bore 2110.

Attaching assembled Muzzle Device 2500 without suppressor element 2560 would result in a blast forwarding device that projects unsuppressed propellant gases out of Muzzle Device 2500 through exhaust holes 2544 parallel to the barrel bore.

Herein above descriptions anticipate a combination of parts machined from bar stock, tube stock and other manufacturing methods to complete IBMDS 1000 and 2000. This disclosure anticipates that either IBMDS 1000 or 2000 could be 3D printed as a monolithic, single piece unit. For example, a monolithic 3D printed version of IBMDS 2000 would no longer have end cap 2520 with exhaust holes 2544. Propellant gases would exit directly from suppressor element 2560 with greater exposed surface area for the gases to escape. Monolithic, 3D printed IBMDS 2000 could have greater heat transfer to atmosphere of the heat stripped out by suppressor element 2560. Eliminating air gap between the inside diameter of tube body 2590 and outside diameter of suppressor element 2560 results in conduction heat transfer to atmosphere throughout the entire IBMDS 2000 unit.

Illustration and description of the Integrated Barrel and Muzzle Device System herein is not limited to the M16/M4/AR15 rifle and can be similarly adapted to other rifles and firearms.

Figure 5:
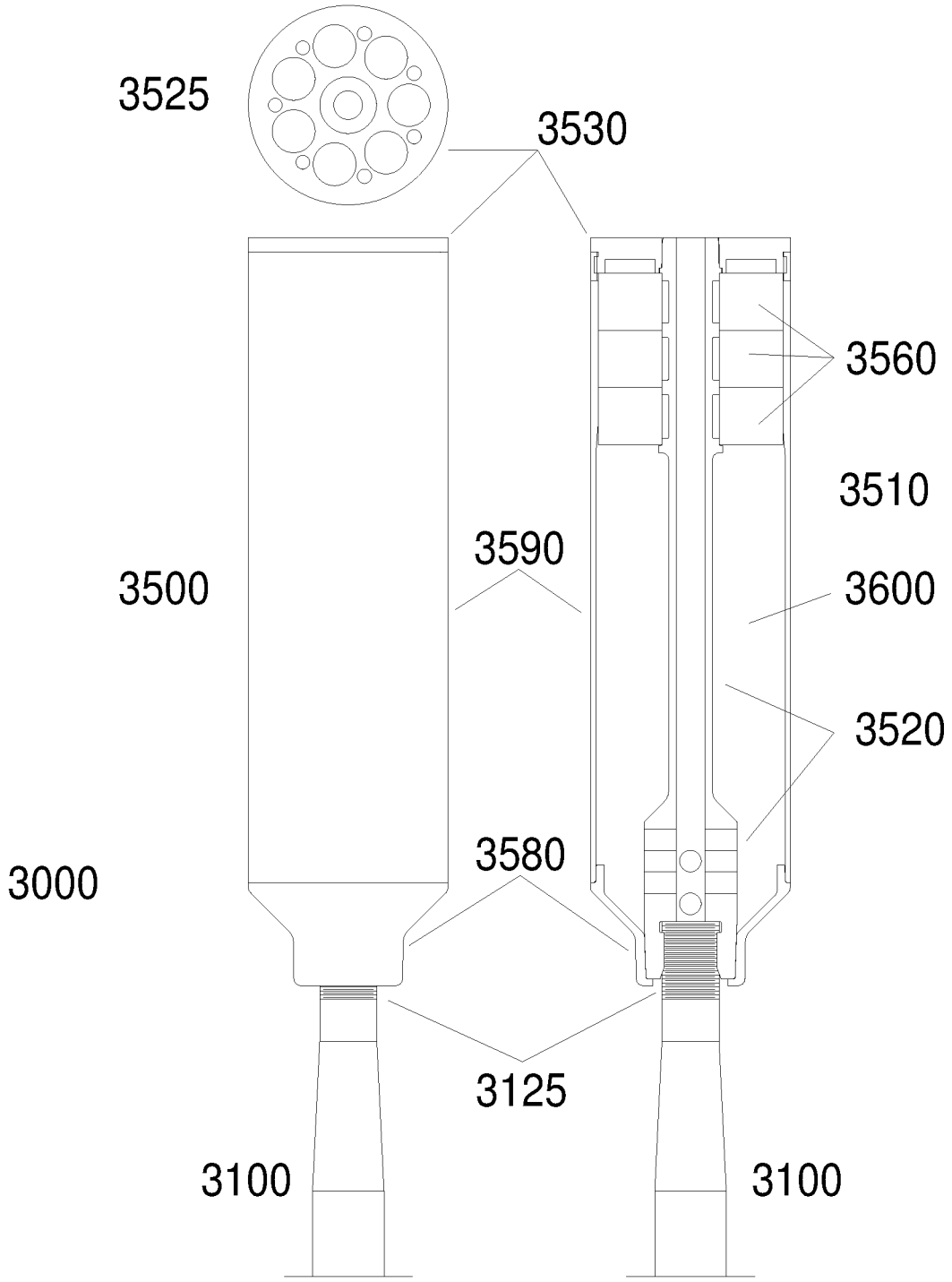
FIG. 5 illustrates another version of Integrated Barrel and Muzzle Device System, hereinafter sometimes IBMDS 3000, applied to the muzzle end of a firearm barrel in accordance with an embodiment of the present disclosure.

FIG. 5 illustrates another version of Integrated Barrel and Muzzle Device System, hereinafter sometimes IBMDS 3000, applied to the muzzle end of a firearm barrel in accordance with an embodiment of the present disclosure. IBMDS 3000 is comprised of two major subsystems, the Barrel 3100 and the Muzzle Device 3500. Barrel 3100 would have a threaded muzzle end 3125. IBMDS 3000 would attach to the threaded end of the firearm barrel 3125 without having to overlap any portion of the firearm barrel 3100 beyond the threaded portion. End view 3525 of Muzzle Device 3500 is included.

IBMDS 3000 does not require the muzzle outside diameter to be greater than the diameter of the external threads. Current suppressors require a shoulder, larger in diameter than the muzzle external threads, to register against or locate when fully attached. When fully attached, IBMDS 3000 registers against the distal face of the barrel muzzle itself. This allows for utilization of the IBMDS 3000 suppressor on legacy firearms that have muzzle outside diameters too small for machining a registration shoulder into the barrel.

FIG. 5 also includes a cross section view 3510 of Muzzle Device 3500, which illustrates front end cap 3580, interchangeable projectile tube 3520, suppressor tube body 3590, suppressor elements 3560 and muzzle end cap 3530 through which propellant gases pass out to atmosphere. In this representation, muzzle end cap 3530 is attached to the interchangeable projectile tube 3520 and not an integral part of the interchangeable projectile tube 3520. Interior space 3600, which receives propellant gases from the interchangeable projectile tube 3520, is exterior to the interchangeable projectile tube 3520 and interior to suppressor tube body 3590.

Figure 6:
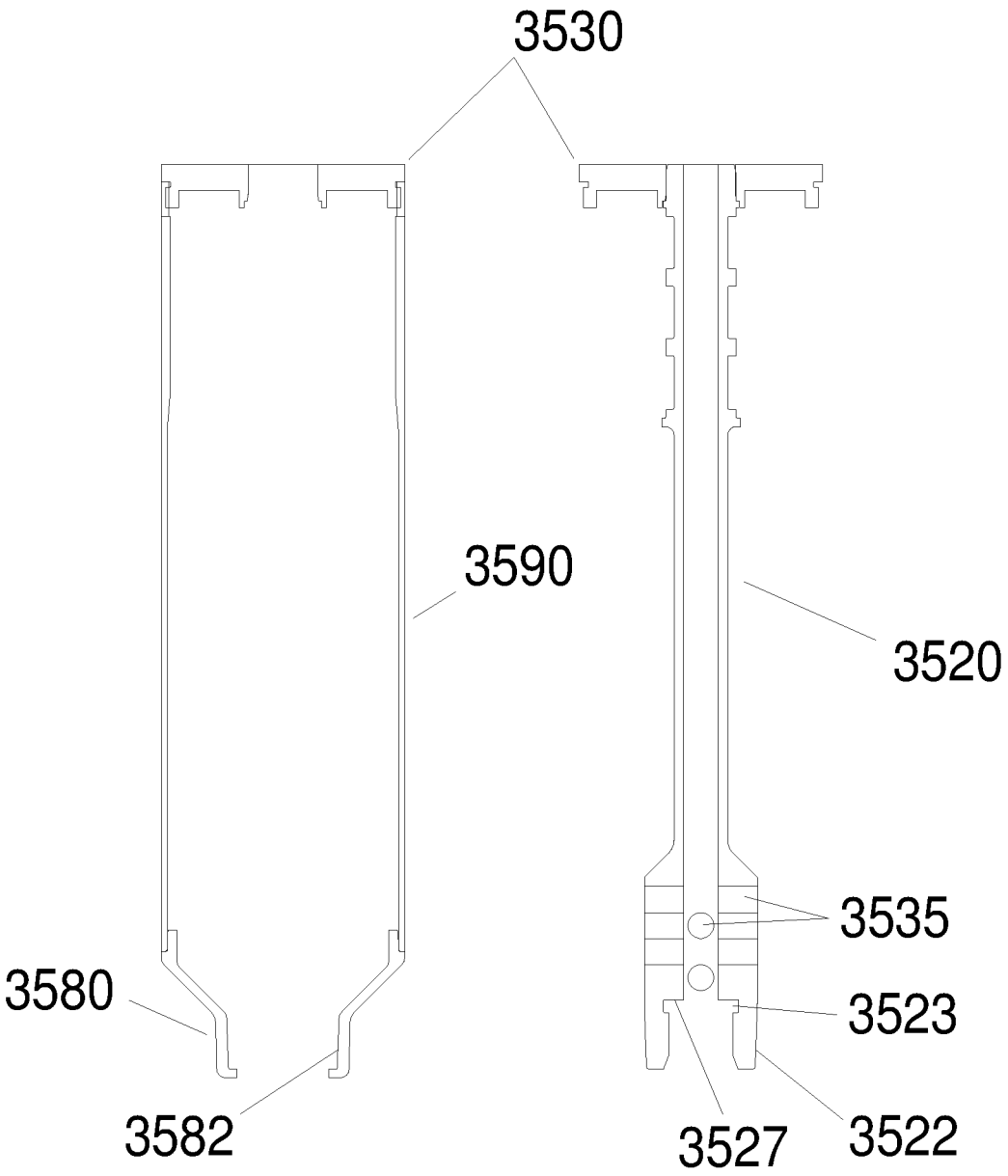
FIG. 6 illustrates Muzzle Device in cross section without Barrel in accordance with an embodiment of the present disclosure. A cross section of projectile tube illustrates vent holes in accordance with an embodiment of the present disclosure.

FIG. 6 illustrates Muzzle Device 3500 in cross section without Barrel 3100 in accordance with an embodiment of the present disclosure. Cross section of the interchangeable projectile tube 3520 illustrates vent holes 3535 in accordance with an embodiment of the present disclosure. Interchangeable Projectile tube 3520 has an external surface and configuration 3522 in a conformal relationship to interior surface and configuration 3582 of front-end cap 3580 when Muzzle Device 3500 is assembled. Interchangeable Projectile tube 3520 has an interior relief cut 3523 that allows the muzzle face of the barrel 3100 to contact and register against the interior face 3527 of projectile tube 3520.

Figure 7:
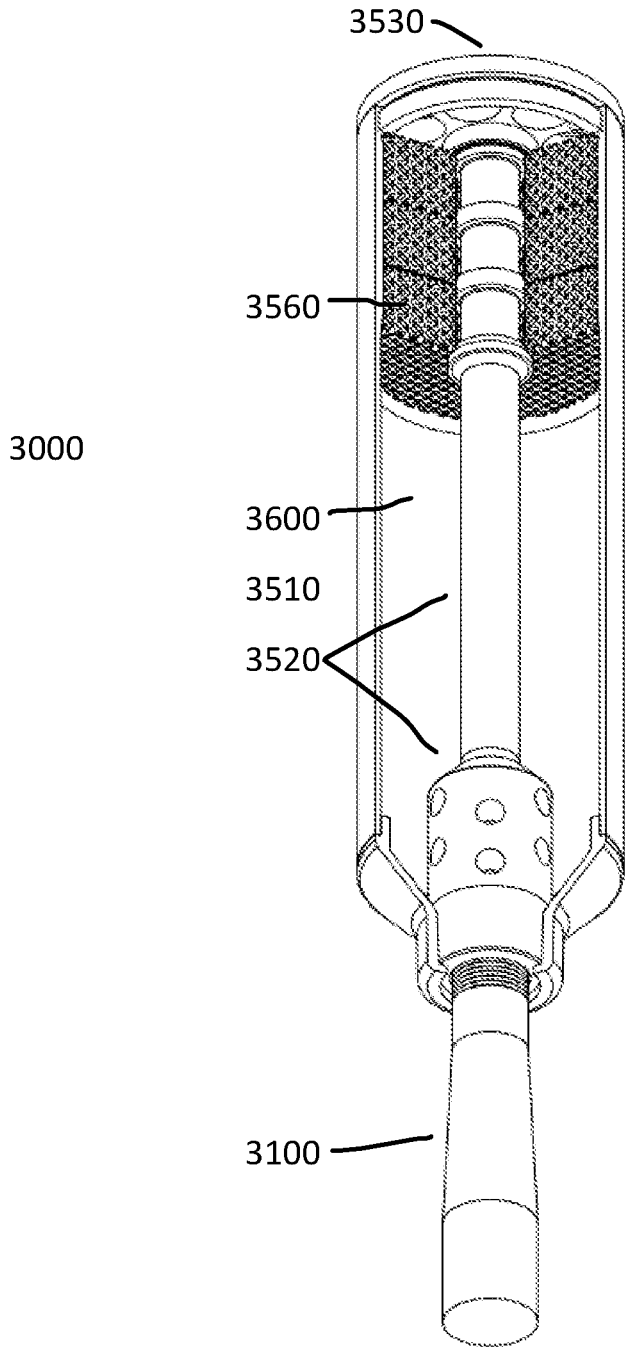
FIG. 7 illustrates a three-dimensional partial section of the muzzle device with the distal end slightly tilted away from vertical in accordance with an embodiment of the present disclosure.

FIG. 7 illustrates a three-dimensional partial section of the muzzle device with the distal end slightly tilted away from vertical in accordance with an embodiment of the present disclosure. Interchangeable Projectile tube 3520 with vent holes 3535 is illustrated solid. Interchangeable Projectile tube 3520 has an external surface and configuration in a conformal relationship to interior surface and configuration with front-end cap 3580 when Muzzle Device 3500 is assembled. Interior space 3600 is illustrated. Suppressor elements 3560 are illustrated in partial section view. Muzzle end cap 3530 is illustrated solid with holes though which propellant gases pass through. The interchangeable projectile tube 3520 is interchangeable with other interchangeable projectile tubes including interchangeable projectile tube 1520.

Embodiments of the disclosure include the projectile tube being interchangeable for each caliber of ammunition. The internal bore diameter is optimized for each size bullet and each projectile tube still uses the same open cellular media for the suppressor elements.

For example, a common caliber rifle bullet is .224" outside diameter (OD). The preferred bore size of the projectile tube for a .224 caliber bullet is approximately .025 to .035" larger than .224"=>.250." Similarly, the preferred bore size of the projectile tube for .308 caliber would be approximately .025 to .035" larger than .308"=>.344," and so forth for different caliber bullets.

Using a .308 caliber projectile tube with a .344" ID (inside diameter) when firing a .224" projectile allows too much clearance for the high pressure propellant gases to bypass the bullet while in the projectile tube. This negatively affects the propellants being vented into the suppressor body and reduces sound attenuation, aka it is louder.

Therefore, an interchangeable projectile tube that vents propellant gases into the suppressor body separates the preponderance of the propellant gases from the projectile. Interchangeable projectile tubes sized for different caliber projectiles minimizes bypass of propellant gases while the projectile moves within the projectile tube.

Interchangeable projectile tubes sized for different caliber projectiles therefore minimizes bypassing of propellant gases while the projectile moves within the projectile tube. Interchangeable projectile tubes also use the same open cellular acoustic media for the different caliber projectiles.

In further embodiments of the disclosure, propellant gases are vented into the body of the suppressor from the barrel, preponderance of the propellant gases and thereby separated from the projectile pathway. Therefore, the propellant gases vented into the suppressor body exit the suppressor independent of the projectile pathway.

The propellant gases vented into the suppressor body pass through an open cell media that attenuates sound, disrupts gas flow, reduces gas pressure and extracts heat from the propellant gases. The open cell media is a single piece annular unit in embodiments and split annular units in other embodiments of the present disclosure. The open cell media is composed of multiple subsidiary pieces that when assembled within the suppressor function similar or equivalent to the single piece annular unit. The open cell media has varying or differential porosities through which the propellant gases and associated sound and heat pass and are filtered by varying and differential wavelengths therefrom. The array of open cell elements comprise a metallic foam, a printed digital metal foam and media with high surface area, low mass, and circuitous and disruptive gas pathways Embodiments of the disclosure include methods of attaching the suppressor to a threaded muzzle end without the barrel diameter being sufficiently large to provide a shoulder for locating the suppressor. In other the suppressor is attached to a threaded muzzle end that locates the suppressor against the distal face of the barrel muzzle.

The advantages of this design include reduced added length beyond the muzzle, superior suppression of sound, muzzle flash and gas blow back into the chamber. The suppressor blast chamber that extends back toward to the rifle chamber is a key feature. Previous versions utilize an interior tube that slides back over the rifle barrel proper. This interior tube adds weight and reduces interior volume but is necessary to fit different barrel shapes of existing riles. Suppressor does not have an interior tube but uses the exterior surface of barrel as the surface of the suppressor blast chamber. Assuming the same suppressor tube OD (outside diameter) and wall thickness, not having the interior tube results in greater blast chamber volume for the same over-the-barrel length, reduced weight by eliminating the interior tube, shorter over-the-barrel length for the same blast chamber volume, reduced material cost and reduced manufacturing complexity.

Suppressor uses bushing attached or welded at the tube end closest to the rifle chamber. Barrel includes a precision machined journal portion with an OD slightly less than the ID of bushing. The length of engagement and dimensional clearance between the suppressor bushing and the barrel journal is sufficient to check the flow of high pressure gases that exit the muzzle and explosively fill the blast chamber. The portion of the barrel adjacent to the muzzle and the over-the-barrel portion of the suppressor are designed to function one with the other. Attaching the suppressor onto a rifle that did not have the matching interface dimensions would render it non-functional. The above described suppressor and rifle barrel relationships can be applied to bolt action barrels and other firearms as well.

Notwithstanding specific embodiments of the invention have been described and illustrated, the invention is not to be limited to the specific forms or arrangements of parts so described and illustrated. The scope of the invention is to be defined by the claims and their equivalents.

What is claimed is:

1. A firearm suppressor comprising:

an interchangeable projectile tube attached to a muzzle endcap and engaged with a front endcap proximal a threaded muzzle of the firearm;

a suppressor tube body configured to receive the muzzle endcap and engage the front endcap located against a distal face of the threaded muzzle, wherein the suppressor tube body receives the interchangeable projectile tube via a dissassembly of the muzzle endcap from the suppressor tube body; and a suppressor element received into the suppressor tube body proximal the muzzle endcap, wherein the suppressor element channels propellant gases from openings defined in the interchangeable projectile tube through an array of open cell elements.

2. The firearm suppressor of claim 1, further comprising one suppressor tube body, one front endcap and one suppressor element for different caliber interchangeable projectile tubes.

3. The firearm suppressor of claim 1, wherein the suppressor tube body is attached to the threaded muzzle via the front endcap.

4. The firearm suppressor of claim of claim 1, wherein the interchangeable projectile tube defines propellant gas slots proximal to the front endcap and the threaded muzzle.

5. The firearm suppressor of claim 1, wherein the interchangeable projectile tube and the muzzle endcap comprise a single piece.

6. The firearm suppressor of claim 1, wherein the suppressor tube body and the front endcap comprise a single piece.

7. The firearm suppressor of claim 1, wherein the interchangeable projectile tube defines an interior face cut in relief to register against the distal face of the threaded muzzle.

8. The firearm suppressor of claim 1, wherein the suppressor tube body receives the suppressor element via a disassembly of the muzzle endcap from the suppressor tube body.

9. The firearm suppressor of claim 1, wherein the suppressor element is confined in a split annular geometry of halves to facilitate removal and cleaning from the passage of the propellant gases.

10. The firearm suppressor of claim 1, wherein the array of open cell elements reduce an acoustic energy of the propellant gases and transfer a heat and reduce a pressure thereof.

11. The firearm suppressor of claim 1, wherein the array of open cell elements comprise open cells of varying and differential porosities to filter an acoustic energy of varying and differential wavelengths of sound therefrom.

12. The firearm suppressor of claim 1, wherein the array of open cell elements comprise a metallic foam, a printed digital metal foam and media with high surface area, low mass, and circuitous and disruptive gas pathways.

13. The firearm suppressor of claim 1, wherein the suppressor is in a mechanical compression between the muzzle endcap and the front endcap to increase a stiffness of the barrel over a portion common with the barrel.

14. The firearm suppressor of claim 1, further comprising a plurality of fins extending inward from an inside diameter of the suppressor tube body.

15. The firearm suppressor of claim 1, wherein an inside diameter of each interchangeable projectile tube is approximately 0.025 inches to 0.035 inches bigger than a bullet diameter.

* * * * *